US008092246B1

(12) United States Patent
Santiago

(10) Patent No.: US 8,092,246 B1
(45) Date of Patent: Jan. 10, 2012

(54) SELF-LOCKING MICRO-D CONNECTOR

(75) Inventor: Caleb Santiago, Winterhaven, FL (US)

(73) Assignee: Lockheed Martin Corporation, Bethesda, MD (US)

( * ) Notice: Subject to any disclaimer, the term of this patent is extended or adjusted under 35 U.S.C. 154(b) by 204 days.

(21) Appl. No.: 12/426,613

(22) Filed: Apr. 20, 2009

Related U.S. Application Data

(60) Provisional application No. 61/046,214, filed on Apr. 18, 2008, provisional application No. 61/081,524, filed on Jul. 17, 2008.

(51) Int. Cl.
*H01R 13/627* (2006.01)

(52) U.S. Cl. ..... 439/357

(58) Field of Classification Search ..... 439/350–358
See application file for complete search history.

(56) References Cited

U.S. PATENT DOCUMENTS

| | | | | |
|---|---|---|---|---|
| 3,409,859 | A * | 11/1968 | Krehbiel | 439/357 |
| 3,523,269 | A * | 8/1970 | Bissland et al. | 439/358 |
| 3,643,232 | A | 2/1972 | Kilby | |
| 3,842,393 | A | 10/1974 | Glover et al. | |
| 4,451,100 | A * | 5/1984 | Jaconette | 439/92 |
| 4,686,463 | A | 8/1987 | Logan | |
| 4,731,577 | A | 3/1988 | Logan | |
| 4,932,883 | A | 6/1990 | Hsia et al. | |
| 4,995,837 | A | 2/1991 | Couper et al. | |
| 5,044,975 | A * | 9/1991 | DiBene, II et al. | 439/352 |
| 5,201,669 | A * | 4/1993 | Lin | 439/357 |
| 5,298,683 | A | 3/1994 | Taylor | |
| 5,431,577 | A | 7/1995 | Lincoln | |
| 5,486,117 | A * | 1/1996 | Chang | 439/357 |
| 5,737,194 | A | 4/1998 | Hopkins et al. | |
| 5,779,496 | A | 7/1998 | Bolinger et al. | |
| 6,071,141 | A * | 6/2000 | Semmeling et al. | 439/353 |
| 6,116,963 | A | 9/2000 | Shutter | |
| 6,146,210 | A * | 11/2000 | Cha et al. | 439/680 |
| 6,257,925 | B1 * | 7/2001 | Jones | 439/557 |
| 6,764,331 | B2 | 7/2004 | Sloan | |
| 6,769,936 | B2 | 8/2004 | Gutierrez et al. | |
| 6,773,298 | B2 | 8/2004 | Gutierrez et al. | |
| 6,821,145 | B1 | 11/2004 | Pollock et al. | |
| 6,821,159 | B2 | 11/2004 | Munger, Jr. et al. | |
| 6,848,943 | B2 | 2/2005 | Machado et al. | |
| 6,945,825 | B2 * | 9/2005 | Aramoto et al. | 439/680 |
| 6,962,511 | B2 | 11/2005 | Gutierrez et al. | |

(Continued)

FOREIGN PATENT DOCUMENTS

WO WO03/094306 11/2003

OTHER PUBLICATIONS

"AirBorn First to Qualify to DOD Namominiature Connector Specification", *Business Wire* Mar. 20, 2006 , 1-2.

(Continued)

*Primary Examiner* — James Harvey
(74) *Attorney, Agent, or Firm* — Jeffrey D. Myers; Steve McLary; Timothy D. Stanley

(57) ABSTRACT

A connector apparatus and concomitant method of connecting first and second Micro-D connectors comprising inserting latches affixed at both ends of the first connector into mounting holes on the second connector and causing locking tabs on the latches to engage with a support portion of the second connector.

15 Claims, 3 Drawing Sheets

U.S. PATENT DOCUMENTS

| | | | | |
|---|---|---|---|---|
| 7,040,910 | B2 * | 5/2006 | Nagata et al. | 439/352 |
| 7,182,640 | B2 | 2/2007 | Garrett et al. | |
| 7,367,851 | B2 | 5/2008 | Machado et al. | |
| 7,387,525 | B1 * | 6/2008 | Huang | 439/352 |
| 2003/0027450 | A1 * | 2/2003 | Nagata et al. | 439/357 |
| 2007/0015416 | A1 | 1/2007 | Gutierrez et al. | |
| 2009/0104819 | A1 * | 4/2009 | Hermant et al. | 439/638 |
| 2009/0215297 | A1 * | 8/2009 | Faoro et al. | 439/273 |

OTHER PUBLICATIONS

Amphenol, R. F. , "SMP and SMPM Subminiature and Microminiature Connectors for Applications to 65 GHz", *Microwave Journal* vol. 47 Mar. 2004 , 32-35.

Cabourne, Michael K. , "Mass Termination of 25 MIL Planar Cable with Micro D Connectors", *Annual Connectors and Interconnection Technology Symposium Proceedings* 1984 , 302-308.

Hoeft, Lothar O. et al., "Measured surface transfer impedance of multi pin micro-D subminiature and LFH connector assemblies at frequencies up to 1 GHz", *IEEE International Symposium on Electromagnetic Compatibility* 1999 , 577-582.

Konnick, Paul J. , "Hermetically Sealed Microminiature Multisocket Connector", *Sandia National Laboratories* 1983 , 1-7.

Madsen, Mark A. , "Nano-Miniature Connectors Stand up to the Elements", *Connector Specifier* Nov. 2003 , 1-5.

O'Hirok, William D. , "Understand MIL Connector Types to Make the Proper Choice", EDN 1983 , 211-220.

Wolfram, Kenneth D. , "A New Radiation-Hardened Satellite Onboard LAN Based on IEEE Std 1394", *American Institute of Aeronautics and Astronautics*Sep. 28, 2004 , 1-12.

* cited by examiner

SELF-LOCKING MICRO-D CONNECTOR

CROSS-REFERENCE TO RELATED APPLICATIONS

This application claims priority to and the benefit of the filing of U.S. Provisional Patent Application Ser. Nos. 61/046,214 and 61/081,524, both entitled "Self-Locking Micro-D Connector", filed on Apr. 18, 2008 and Jul. 17, 2008, respectively, and the specifications and claims thereof are incorporated herein by reference.

STATEMENT REGARDING FEDERALLY SPONSORED RESEARCH OR DEVELOPMENT

Not Applicable.

INCORPORATION BY REFERENCE OF MATERIAL SUBMITTED ON A COMPACT DISC

Not Applicable.

COPYRIGHTED MATERIAL

Not Applicable.

BACKGROUND OF THE INVENTION

1. Field of the Invention (Technical Field)

The present invention relates to electrical connectors, particularly to military grade Micro-D (microminiature and nanominiature) connectors.

2. Description of Related Art

Multiple mates and de-mates of Micro-D (military grade microminiature and nanominiature) connectors, such as the 83513 Micro-D connector, during testing and/or in the field require that the two mating halves be fastened with hardware. This hardware is small and is occasionally lost creating FOD (foreign object debris). Furthermore, having the proper set of tools to install the hardware is not always available especially in the field under extremely harsh or adverse conditions (e.g., military). Accordingly, the present invention provides a viable option for locking Micro-D connectors without the use of additional hardware under conditions (test and military field of operation) that does not necessitate the traditional use of additional jackscrews and nuts.

BRIEF SUMMARY OF THE INVENTION

The present invention is of a connector apparatus and concomitant method of connecting first and second Micro-D connectors comprising: inserting latches affixed at both ends of the first connector into mounting holes on the second connector; and causing locking tabs on the latches to engage with a support portion of the second connector. In the preferred embodiment, the invention additionally comprises depressing the locking tabs to release them from the support portion and extracting the latches from the mounting holes, thereby disconnecting the first and second Micro-D connectors. No additional hardware is required, and the connectors are capable of being disengaged from one another by hand. The mounting holes are at opposite ends of the second connector, the latches comprise raised end portions, and the locking tabs are on a mid portion of the latches and face outward from the first connector.

The invention is also of a connector apparatus and concomitant method of disconnecting first and second Micro-D connectors comprising: depressing locking tabs on latches affixed at both ends of the first connector to release them from a support portion of the second connector; and extracting the latches from mounting holes on the second connector, thereby disconnecting the first and second Micro-D connectors. In the preferred embodiment, the invention additionally comprises inserting the latches into the mounting holes on the second connector and causing the locking tabs on the latches to engage with the support portion of the second connector. Again, the invention does not require additional hardware.

Further scope of applicability of the present invention will be set forth in part in the detailed description to follow, taken in conjunction with the accompanying drawings, and in part will become apparent to those skilled in the art upon examination of the following, or may be learned by practice of the invention. The objects and advantages of the invention may be realized and attained by means of the instrumentalities and combinations particularly pointed out in the appended claims.

BRIEF DESCRIPTION OF THE SEVERAL VIEWS OF THE DRAWINGS

The accompanying drawings, which are incorporated into and form a part of the specification, illustrate one or more embodiments of the present invention and, together with the description, serve to explain the principles of the invention. The drawings are only for the purpose of illustrating one or more preferred embodiments of the invention and are not to be construed as limiting the invention. In the drawings.

DETAILED DESCRIPTION OF THE INVENTION

The present invention is of a Micro-D connector that does not necessitate additional hardware to deploy, mate, and/or to de-mate (DuaLoc™). By mechanical means or welding, locking latches are attached on each end of the receptacle connector which line up with the mating plug's two mounting holes. The Micro-D connector of the invention can now be mated and firmly locked. Modifications of the connectors metal shell (no changes or modifications to the connector interface or mating face) preferably include the removal of the flanges where the mounting holes are located and extension of the shell to accommodate the locking latches. By depressing the latch the connector can pulled to de-mate.

Throughout the specification, attachments, and claims, "Micro-D connector" means electrical connectors consistent with U.S. Defense Supply Center Detail Specification MIL-DTL-83513F (dated Mar. 22, 2007), U.S. Defense Supply Center Detail Specification MIL-DTL-32139A (dated Jun. 23, 2006), predecessor and successor versions of those specifications, and similarly sized non-military electrical connectors.

Figure 2:
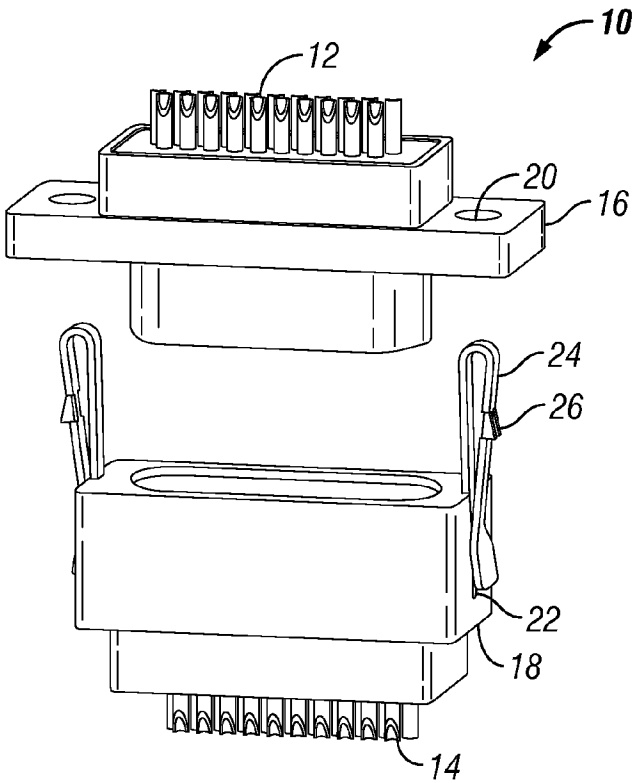
FIG. 2 is a front perspective view of the invention de-mated.
Figure 1:
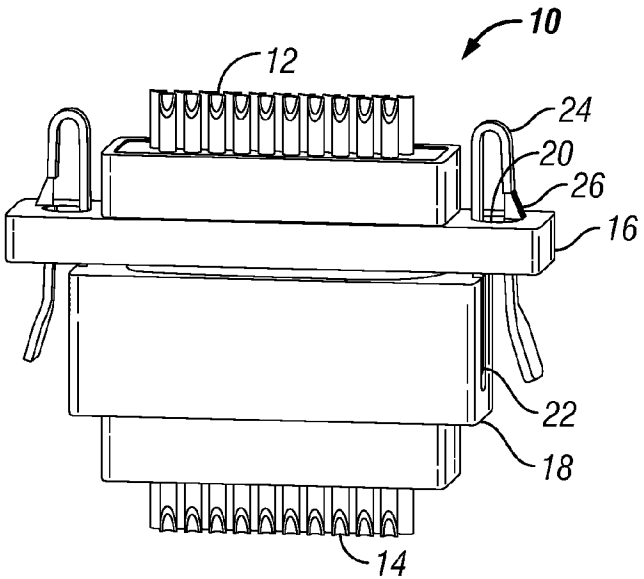
FIG. 1 is a front perspective view of the apparatus of the invention in mated form.
Figure 4:
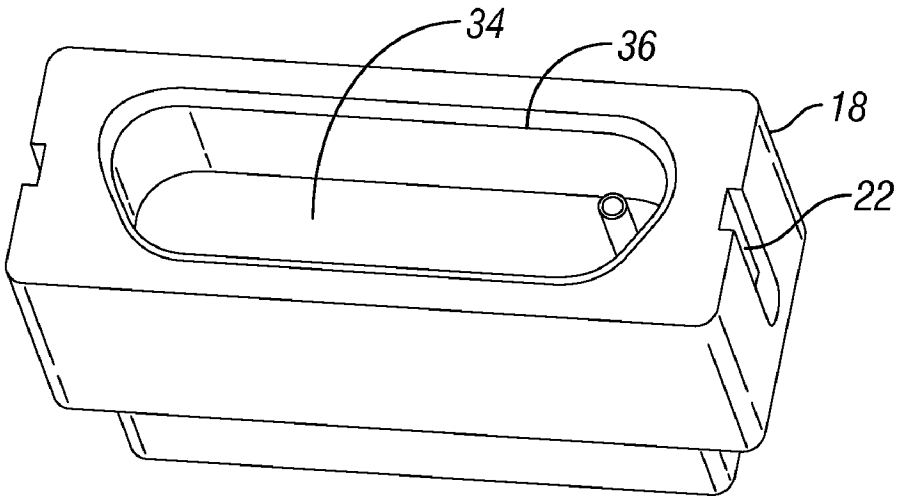
FIG. 4 is a top perspective view of the lower housing of the invention.
Figure 3:
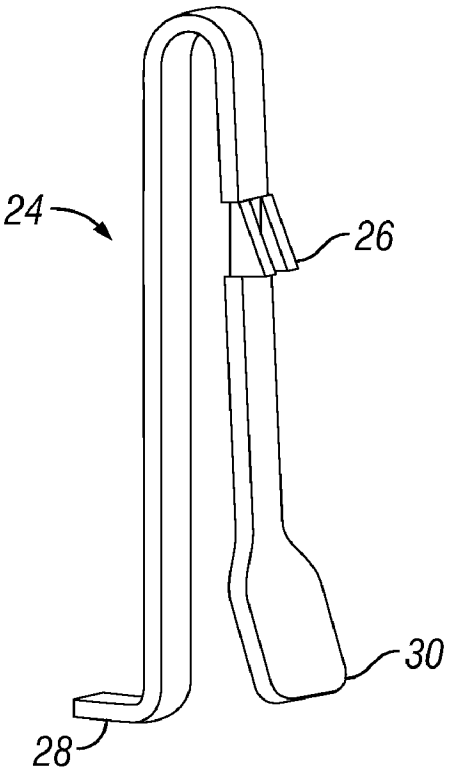
FIG. 3 is a front perspective view of a latch of the invention.
Figure 6:
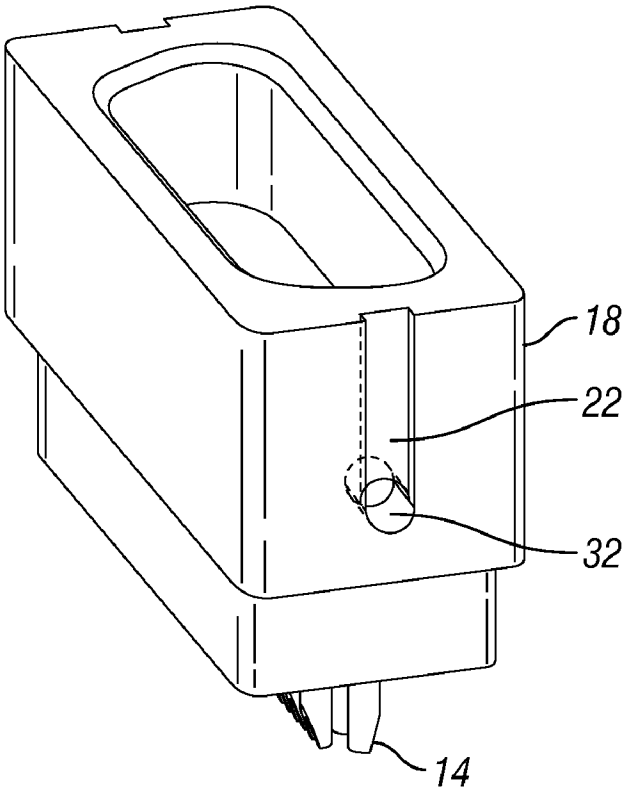
FIG. 6 is a side perspective view of the lower housing.
Figure 5:
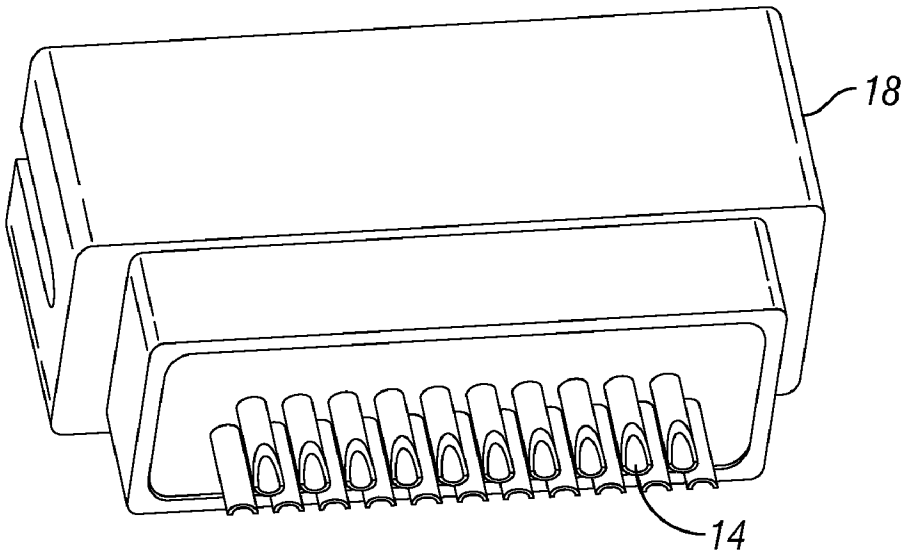
FIG. 5 is a bottom perspective view of the lower housing of the invention.

A preferred embodiment 10 is illustrated in FIGS. 1-6, comprising upper pin set 12, lower pin set 14, upper housing 16, lower housing 18, upper housing openings 20, lower housing slots 22, locking latches 24, locking tabs 26, lower tabs 28, end portions 30, lower housing openings 32, recess 34, and pass through connection(s) 36. Although the configuration shown has only a single pass-through connection 36, any number of the pins present can be provided with a pass-through connection.

The locking latches are preferably made of a metal complying with the Micro-D connector requirements, but can be any resilient material such as a flexible plastic. The locking latches are secured to the lower housing via insertion of their lower tabs into the lower housing openings such that the body of the latches rest in the lower housing slots. Depressing the end portions of the latches disengages the locking tabs from the upper housing openings, permitting the two portions of the connector to be de-mated. Mating is accomplished simply by directing the latches through the upper housing openings until the locking latches are seated to and engaged with support portions of the first housing. The two portions of the connector are then firmly attached to one another until such time as the end portions of both locking latches are again depressed.

Note that in the specification and claims, "about" or "approximately" means within twenty percent (20%) of the numerical amount cited. Although the embodiment illustrated provides a 21-pin configuration, the invention works with any number of pins, including 9-pin, 15-pin, 25-pin, 31-pin, 37-pin, 51-pin (one or two rows), 67-pin, 69-pin, and 100-pin configurations.

Although the invention has been described in detail with particular reference to these preferred embodiments, other embodiments can achieve the same results. Variations and modifications of the present invention will be obvious to those skilled in the art and it is intended to cover in the appended claims all such modifications and equivalents. The entire disclosures of all references, applications, patents, and publications cited above are hereby incorporated by reference.

What is claimed is:

1. A latch for a Micro-D connector capable of being disengaged by hand comprising latches external to said connector affixed at opposite ends of said connector, said latches comprising locking tabs and comprising a U shape extending outwardly from said connector, wherein tops of said U shape fall between planes defined by forward and trailing edges of said connector.

2. The connector of claim 1 wherein said latches are sized to fit through mounting holes on a mating connector housing.

3. The connector of claim 2 wherein said locking tabs lock onto portions of one of said mating connector housings adjacent said mounting holes.

4. A method of releasably connecting first and second Micro-D connectors, the method comprising the steps of:

inserting latches externally affixed at both ends of the first connector and comprising a U shape extending outwardly from the first connector into external mounting holes on the second connector, wherein tops of the U shape fall between planes defined by forward and trailing edges of the first connector; and causing locking tabs on the latches to engage with a portion of the second connector adjacent said mounting hole.

5. The connector of claim 1 wherein said connector is capable of being firmly secured to a mating connector without additional hardware.

6. The method of claim 4 wherein the locking tabs are on a mid portion of the latches and face outward from the first connector.

7. The connector of claim 1 wherein said latches are secured to slots at opposite ends of said connector.

8. The connector of claim 7 wherein said latches include tabs inserted into said slots.

9. The connector of claim 1 wherein said latches include raised end portions for releasing said tabs from locking engagement.

10. The connector of claim 1 wherein said tabs are on a mid portion of said latches and face outward from said connector.

11. The method of claim 4 wherein the latches comprise raised end portions.

12. The method of claim 4 additionally comprising the steps of:

depressing the locking tabs to release them from the second connector; and extracting the latches from the mounting holes, thereby disconnecting the first and second Micro-D connectors.

13. The method of claim 4 wherein the method does not require additional hardware.

14. The method of claim 13 wherein after the method is complete the connectors are capable of being disengaged from one another by hand.

15. The method of claim 4 wherein the mounting holes are at opposite ends of the second connector.

* * * * *